US007070183B2

(12) United States Patent
Moffett, VI et al.

(10) Patent No.: US 7,070,183 B2
(45) Date of Patent: Jul. 4, 2006

(54) GAMING DEVICE

(76) Inventors: Nicholas D. Moffett, VI, 1106 Elkhorn Peak La., Spearfish, SD (US) 57783; Emily S. Nelson, 203 W. 20th St., Sioux Falls, SD (US) 57105

( * ) Notice: Subject to any disclaimer, the term of this patent is extended or adjusted under 35 U.S.C. 154(b) by 0 days.

(21) Appl. No.: 10/800,966

(22) Filed: Mar. 16, 2004

(65) Prior Publication Data

US 2004/0222585 A1 Nov. 11, 2004

Related U.S. Application Data

(63) Continuation-in-part of application No. 09/988,794, filed on Nov. 20, 2001, now abandoned.

(60) Provisional application No. 60/251,427, filed on Dec. 6, 2000.

(51) Int. Cl.
*A63F 7/02* (2006.01)

(52) U.S. Cl. ..... 273/118 R; 273/119 R; 273/138.1

(58) Field of Classification Search ..... 273/118 R, 273/118 A, 118 D, 119 R, 119 A, 121 R, 273/121 A, 138.1, 143 R, 108
See application file for complete search history.

(56) References Cited

U.S. PATENT DOCUMENTS

| | | | | |
|---|---|---|---|---|
| 3,853,318 A | | 12/1974 | Cagan | |
| D251,515 S | | 4/1979 | Richter et al. | |
| D260,409 S | | 8/1981 | Tanaka et al. | |
| 4,508,345 A | | 4/1985 | Okada | |
| 4,518,098 A | | 5/1985 | Fleischer | |
| 5,010,995 A | | 4/1991 | Okada | |
| D337,790 S | | 7/1993 | Gottlieb et al. | |
| 5,342,049 A | | 8/1994 | Wichinsky et al. | |
| 5,630,586 A | | 5/1997 | Lowden | |
| 5,882,261 A | | 3/1999 | Adams | |
| 5,997,400 A | | 12/1999 | Seelig et al. | |
| 6,047,963 A | * | 4/2000 | Pierce et al. | 273/121 B |
| 6,089,976 A | | 7/2000 | Schneider et al. | |
| 6,089,978 A | | 7/2000 | Adams | |
| 6,203,008 B1 | * | 3/2001 | Krise et al. | 273/121 B |

FOREIGN PATENT DOCUMENTS

| | | |
|---|---|---|
| GB | 2 083 936 A | 3/1982 |
| GB | 2 182 186 A | 5/1987 |
| GB | 2 201 821 A | 9/1988 |

* cited by examiner

*Primary Examiner*—Raleigh W. Chiu
(74) *Attorney, Agent, or Firm*—Selby & Panka, LLC

(57) ABSTRACT

A combination of a slot machine and a pinball machine. The top section of the invention replicates a conventional reel-type slot machine, whereas the bottom section of the device is a conventional pinball machine. The slot machine is designed with solid sides and a stable base to prevent tilting, which commonly occurs during pinball play. A single handle allows a player to spin the slot reels or launch the pinball into action. The machine is equipped with various indicators and coin insert slots which allow a player to initiate play and monitor the results.

20 Claims, 3 Drawing Sheets

GAMING DEVICE

CROSS-REFERENCE TO RELATED APPLICATION

This application is a continuation-in-part of application Ser. No. 09/988,794 filed Nov. 20, 2001, now abandoned which claims the benefit of U.S. Provisional Patent Application Ser. No. 60/251,427, filed Dec. 6, 2000.

BACKGROUND OF THE INVENTION

1. Field of the Invention

The present invention generally relates to gaming devices. More specifically, the present invention is drawn to a pinball-slot machine combination.

2. Description of Related Art

"Gaming" or the participation of people in wagering games is probably as old as civilization and is world-wide in scope. In the last half of the twentieth century, the proliferation of casinos in the United States alone is evidence that games of chance are still enjoyed by large numbers of people. To maintain and enhance client interest, casino operators are always searching for new and interesting gaming formats. The present invention proposes a new and exciting game of chance, which involves a merger of the widely popular pinball and slot machine games.

Variations of pinball gaming devices are shown in U.S. Pat. No. Des. 251,515 (Richter), Des. 260,409 (Tanaka et al.) and Des. 337,790 (Gottlieb et al.). These patents merely show ornamental designs of pinball machines.

The most popular gaming device is probably the slot machine, variations of which are disclosed in U.S. Pat. No. 4,508,345 (Okada), U.S. Pat. No. 5,010,995 (Okada), British Patent 2 083 936A, and British Patent 2 182 186A. Only the well-known reel game may be played on the above cited slot machines.

U.S. Pat. No. 4,518,098 (Fleischer) shows a vending machine designed to appear as a slot machine.

U.S. Pat. No. 3,853,318 (Cagan) discloses a combination dart and pinball device. There appears to be no provision in the Cagan device for inserting coins for wagering.

U.S. Pat. No. 5,630,586 (Lowden), U.S. Pat. No. 5,997,400 (Seelig et al.), U.S. Pat. No. 6,089,976 (Schneider et al.), U.S. Pat. No. 6,089,978 (Adams) and British Patent number 2 201 821A all disclose combination gaming devices. However, none incorporate a pinball-slot machine merger.

U.S. Pat. No. 5,882,261 (Adams) shows a gaming device that incorporates a pinball-type game with a slot machine. The device of the instant patent differs from the proposed invention in arrangement and mode of play.

U.S. Pat. No. 5,342,049 (Wichinsky et al.) discloses a combination slot machine and pinball-type machine. Note that when in the pinball mode, Wichinsky et al. contemplate re-spinning the slot reels instead of directly adding credits.

None of the above inventions and patents, taken either singly or in combination, is seen to disclose the invention as will subsequently be described and claimed in the instant invention

SUMMARY OF THE INVENTION

The present invention, dubbed "Slotball", is a combination of a slot machine and a pinball machine. As presently contemplated, the top section of the invention replicates a conventional reel-type slot machine, whereas the bottom section of the device is a conventional pinball machine. The slotball machine is designed with solid sides and a stable base to prevent tilting, which commonly occurs during pinball play. A single handle allows a player to spin the slot reels, or launch the pinball into action. A button may also be utilized to spin the slot reels. The slotball machine is equipped with various indicators and coin insert slots which allow a player to initiate play and monitor the results.

The objectives of the game are to win credits, win the slot jackpot, or to achieve the slotball bonus round to win extra credits. Play is initiated when the machine is in the slot mode. Play in the pinball mode can only be achieved if the slotball icon appears as will be explained below.

Accordingly, the instant invention provides a new and exciting gaming apparatus that combines the characteristics of two of the most popular game machines, namely the slot and pinball machines. The invention also provides for improved elements and arrangements thereof in a method and apparatus for the purposes described which are inexpensive, dependable and fully effective in accomplishing their intended purposes.

The present invention will become readily apparent upon further review of the following specification and drawings.

DETAILED DESCRIPTION OF THE PREFERRED EMBODIMENT

Figure 1:
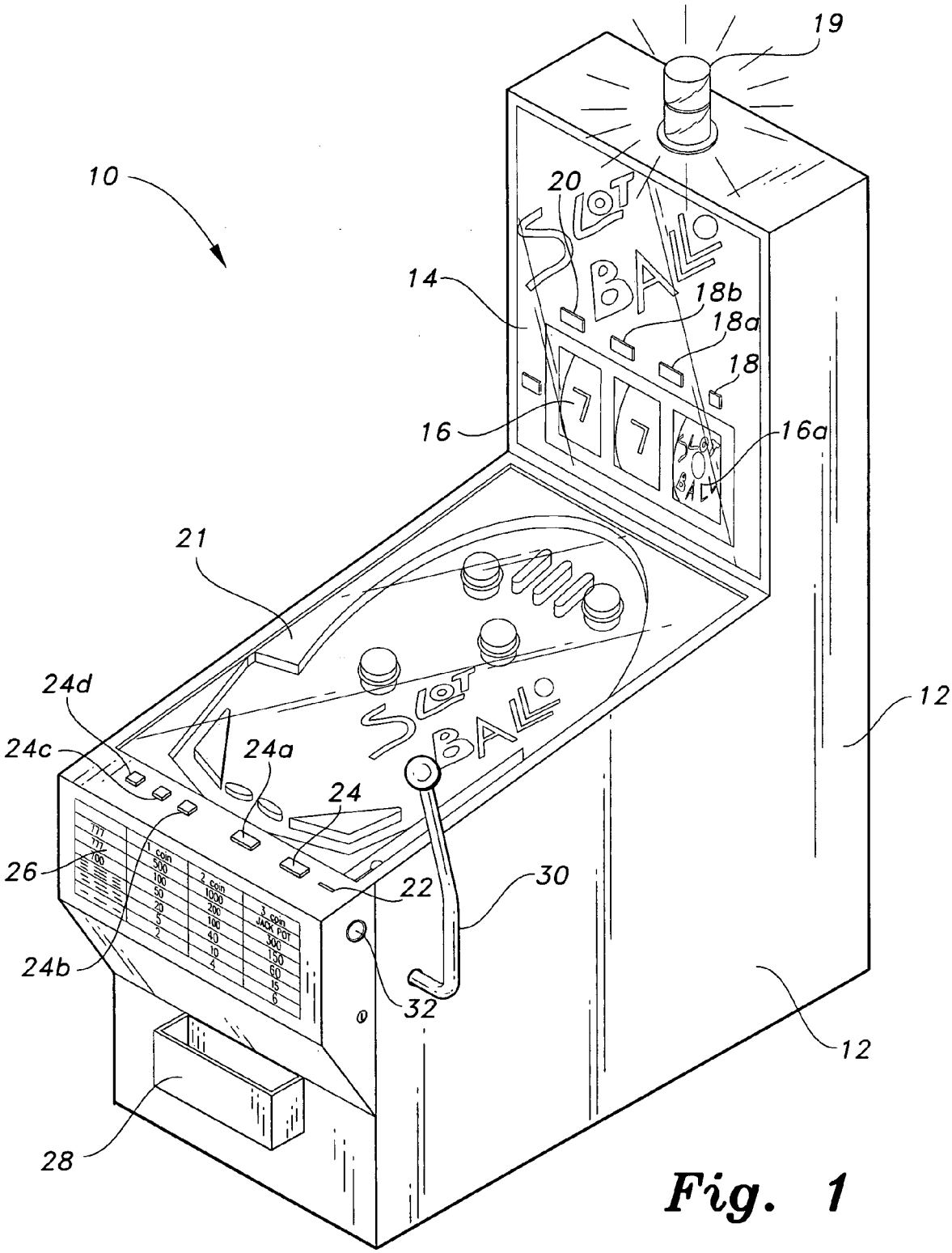
FIG. 1 is a perspective view of a gaming device according to the present invention.
Figure 2:
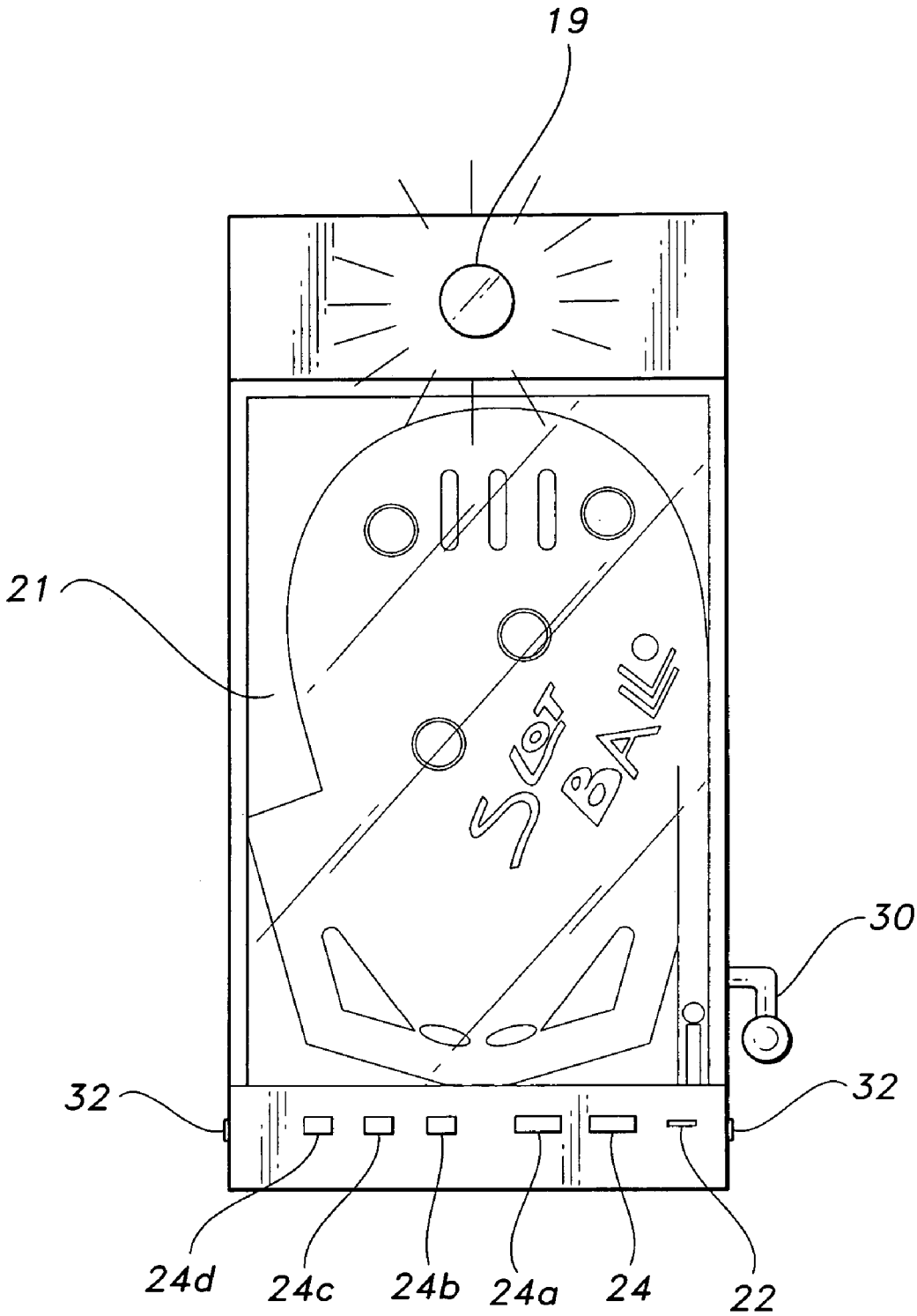
FIG. 2 is a top view of a gaming device according to the present invention.
Figure 3:
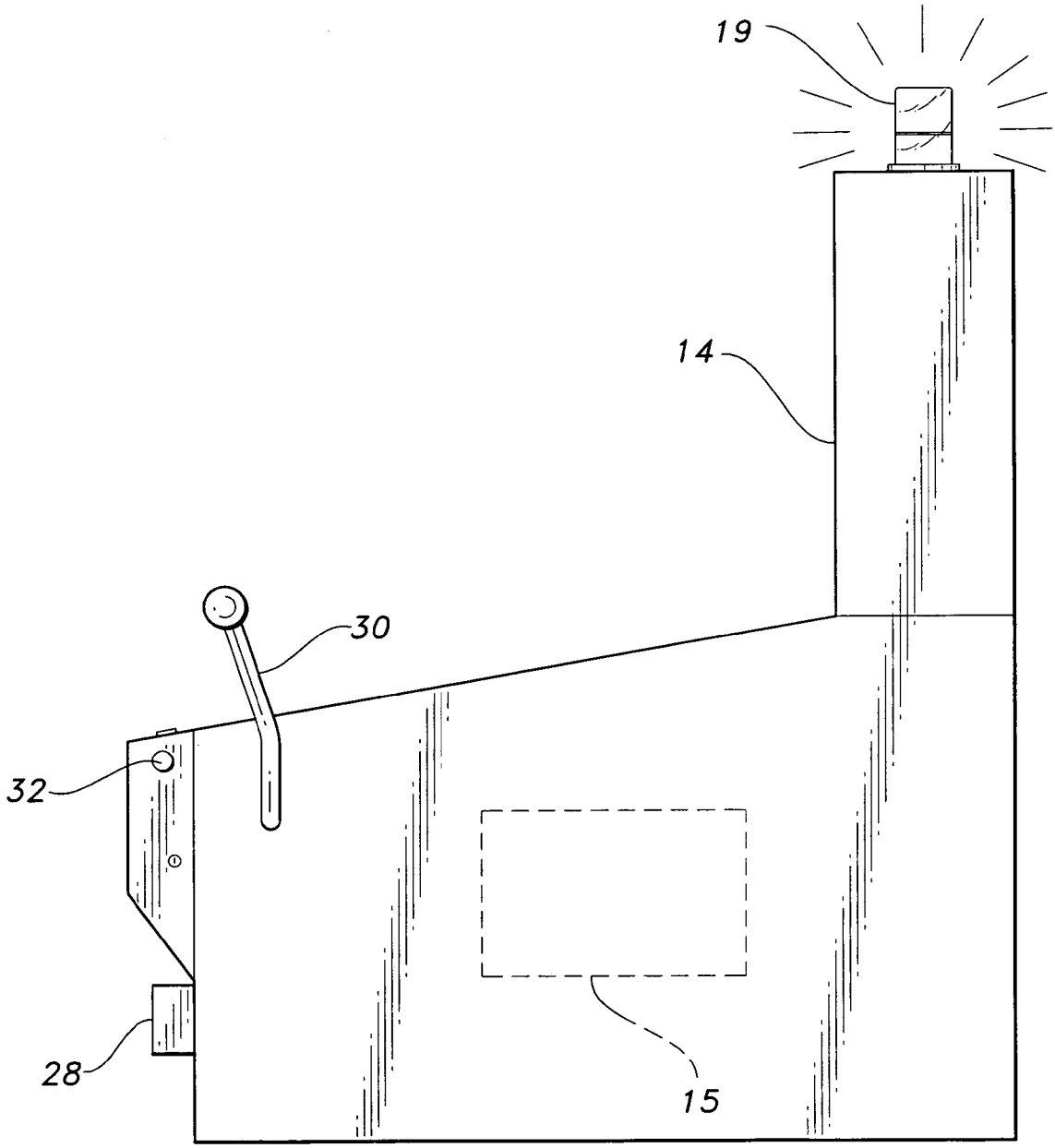
FIG. 3 is a side view of a gaming device according to the present invention.

The gaming apparatus of the present invention is generally indicated at 10 as illustrated in FIGS. 1–3. Apparatus 10 includes walls 12 which support and house conventional mechanical and electromechanical mechanisms 15 for operating a combination slot-pinball machine game. Walls 12 are designed to form a solid base to prevent the apparatus from being easily tilted. Although walls are illustrated as the support means, it is obvious that sturdy legs (or the like) could be utilized if desired.

The upper section 14 of the gaming apparatus is designed to appear and function as a conventional slot machine and includes slot reels 16 and indicator lights 18, 18*a*, 18*b*. Indicator 18 gives a reading for credits played; 18*a* indicates credits won in the pinball mode; 18*b* indicates total credits available. Indicator light 20 is the winner paid indicator. Slot reels 16 exhibit the standard payline and slot icons (sevens, bars, cherries, etc.). The instant invention however, requires at least one reel to employ an icon with the words "slot ball" inscribed thereon as shown at 16*a*. A light 19 is adapted to flash to indicate either when a machine error occurs or when a player has hit the jackpot.

The lower section 21 of the apparatus is designed to appear and function as a pinball machine. Lower section 21 includes a control panel that incorporates the following functions. A coin slot 22 is provided for inserting coins or casino tokens to initiate the apparatus game mechanisms. Push button 24 is utilized to place a maximum credit bet. Push button 24*a* may be used to activate the slot reels. Button 24*b* is employed when a player wishes to input the amount of credits bet (from one to the maximum amount). Button 24*c* is used when a player decides to terminate play and wishes to cash out. Button 24*d* is a service button. For convenience, a pay scale 26 is inscribed on the front wall of the apparatus. A tray 28 for catching the player's winnings is positioned immediately beneath the pay scale. A handle 30 may be employed to activate the slot reels or launch the pinball when in pinball mode. Buttons 32 functions to move the pinball flippers (not shown) as is conventional in the art.

To initiate play, the player inserts coins or gaming tokens into coin slot 22. The player may bet any desired amount. However, the player cannot qualify for the slot jackpot and the slotball bonus round if maximum credits are not bet. Handle 30, button 24 or button 24*a* is then manipulated to start slot reels 16. If the slotball icon 16*a* appears on the payline and the maximum amount of credits have been bet, the machine will automatically switch into the pinball mode. The player will then be able to win extra credits playing pinball. Once the pinball mode is activated, the machine will automatically place a pinball into the launch position. Handle 30 is employed to launch the pinball. As in ordinary pinball games, the player manipulates the pinball by pressing buttons 32, which buttons cause the flippers (not shown) to direct the pinball to strike credit adding or credit subtracting sensors. When the pinball goes out of play, the game reverts to the slot mode. The player has a choice of continuing to play by repeating the above process or to cash out.

It is to be understood that the present invention is not limited to the sole embodiments described above, but encompasses any and all embodiments within the scope of the following claims.

We claim:

1. A gaming apparatus operable by a player and having a slot mode and a pinball mode, the apparatus comprising:

a slot machine capable of being activated by a player in the slot mode of the apparatus to display different combinations of symbols, the symbols including a pinball symbol;

a pinball machine disposed below the symbols of the slot machine and operable in the pinball mode for the player to play a pinball game;

at least one of the combinations of symbols including the pinball symbol, the apparatus switching from the slot mode to the pinball mode upon display of said one combination by the slot machine.

2. The gaming apparatus set forth in claim 1 wherein the gaming apparatus continues in the slot mode if a combination of symbols not including the pinball symbol is displayed.

3. The gaming apparatus set forth in claim 2 wherein the slot machine includes a pay line and the slot machine symbols are displayed relative to the pay line.

4. The gaming apparatus set forth in claim 3 wherein the slot machine further includes slot reels moveable relative to the slot machine, the slot machine symbols being arranged on the slot reels for movement therewith.

5. The gaming apparatus set forth in claim 1 wherein the pinball machine is constructed so that the player can act to keep the pinball in play to continue operation of the apparatus in the pinball mode.

6. The gaming apparatus set forth in claim 5 wherein the pinball machine includes a play area, a pinball, and a flipper, the pinball being moveable within the play area by the flipper during operation of the pinball machine in the pinball mode, the pinball mode ending and the pinball mode switching to the slot mode when the player allows the pinball to move out of the play area.

7. The gaming apparatus set forth in claim 6 wherein the pinball machine further includes a credit adding sensor and a credit subtracting sensor, the pinball being moveable within the play area by the flipper during operation of the pinball machine to interactively move the pinball into contact with the sensors within the play area to create a pinball credit score that is added to a slot credit score when the gaming apparatus switches from the pinball mode to the slot mode.

8. The gaming apparatus set forth in claim 6 wherein the slot machine includes a lever, the slot lever being operable by the player in the slot mode to activate the slot machine, and the slot lever being operable by the player in the pinball mode to launch the pinball. Into the play area.

9. The gaming apparatus set forth in claim 1 wherein operation of the pinball machine in the pinball mode cannot affect the combination of symbols displayed by the slot machine.

10. The gaming apparatus set forth in claim 1 further comprising a lever, the lever being operable by the player to activate the slot machine in the slot mode of the apparatus, the lever being further operable by the player to play the pinball game in the pinball mode of the apparatus.

11. The gaming apparatus set forth in claim 1 wherein the pinball machine includes a play area oriented at an angle greater than zero degrees and less than ninety degrees above horizontal.

12. The gaming apparatus set forth in claim 11 wherein the pinball machines includes a pinball and the play area includes a substantially planar surface, the pinball rolling over the surface of the play area during operation of the pinball machine in the pinball mode.

13. A gaming apparatus operable by a player and having a slot mode and a pinball mode, the appartus comprising:

a slot machine capable of being activated by a player in the slot mode of the apparatus to display different combinations of symbols, the symbols including a pinball symbol;

a pinball machine operable in the pinball mode for the player to play a pinball game, the pinball machine including at least two flippers;

at least one of the combinations of symbols including the pinball symbol, the apparatus switching from the slot mode to the pinball mode upon display of said one combination by the slot machine.

14. The gaming apparatus set forth in claim 13 wherein the pinball machine further includes a play area, the play area being oriented at an angle greater than zero degrees and less than ninety degrees above horizontal.

15. The gaming apparatus set forth in claim 14 wherein the pinball machine further includes a plunger and a pinball, the plunger moving the pinball into the play area for playing the pinball game, the pinball rolling over the play area during operation of the pinball machine in the pinball mode.

16. A gaming apparatus operable by a player and having a slot mode and a pinball mode, the apparatus comprising:

a slot machine capable of being activated by a player in the slot mode of the apparatus to display different combinations of symbols, the symbols including a pinball symbol;

a pinball machine operable in the pinball mode for the player to play a pinball game;

the pinball machine including a play area, the play area being oriented at an angle greater than zero degrees and less than ninety degrees above horizontal;

at least one of the combinations of symbols including the pinball symbol, the apparatus switching from the slot mode to the pinball mode upon display of said one combination by the slot machine.

17. The gaming apparatus set forth in claim 16 wherein the pinball machine includes a pinball and the play area of the pinball machine includes a substantially planar surface, the pinball rolling over the surface of the play area during operation of the pinball machine in the pinball mode.

18. The gaming apparatus set forth in claim 16 further comprising a lever, the lever being operable by the player to activate the slot machine in the slot mode of the apparatus, the lever being further operable by the player to play the pinball game in the pinball mode of the apparatus.

19. The gaming apparatus set forth in claim 16 wherein the slot machine can be activated by the player in the slot mode to create a slot credit score and the pinball machine is operable by the player in the pinball mode to create a pinball credit score, the pinball credit score being added to the slot credit score when the pinball game ends and the gaming apparatus switches from the pinball mode to the slot mode.

20. A gaming apparatus operable by a player and having a slot mode and a pinball mode, the apparatus comprising:

a slot machine capable of being activated by a player in the slot mode of the apparatus to display different combinations of symbols and to create a slot credit score, the symbols including a pinball symbol;

a pinball machine operable in the pinball mode for the player to play a pinball game and create a pinball credit score;

at least one of the combinations of symbols including the pinball symbol, the apparatus switching from the slot mode to the pinball mode upon display of said one combination by the slot machine;

the pinball credit score being added to the slot credit score when the pinball game ends and the gaming apparatus switches from the pinball mode to the slot mode.

* * * * *